United States Patent [19]

Filippos

[11] 4,437,840

[45] Mar. 20, 1984

[54] SWIMMING WHEEL APPARATUS

[76] Inventor: Makram I. Filippos, 102 Oakland Ave., Jersey City, N.J. 07306

[21] Appl. No.: 316,771

[22] Filed: Oct. 30, 1981

[51] Int. Cl.[3] ..... A63B 35/04

[52] U.S. Cl. ..... 440/27; 440/91

[58] Field of Search ..... 440/21, 26, 27, 31, 440/91

[56] References Cited

U.S. PATENT DOCUMENTS

| | | | |
|---|---|---|---|
| 1,520,391 | 12/1924 | Altoonian | 440/31 |
| 1,640,390 | 8/1927 | Bacon | 440/27 |
| 1,728,103 | 9/1929 | Chaligne | 440/31 X |
| 3,062,174 | 11/1962 | Good | 440/31 |
| 3,999,501 | 12/1976 | Duarte | 440/27 |

*Primary Examiner*—Sherman D. Basinger

*Attorney, Agent, or Firm*—Richard L. Miller

[57] ABSTRACT

An aquatic craft for a swimmer; including a pair of pontoons, a frame therebetween on which the swimmer reclines, and a paddle wheel powered by the swimmer.

2 Claims, 5 Drawing Figures

SWIMMING WHEEL APPARATUS

This invention relates generally to swimming apparatus for aiding swimmers to travel in the water.

BACKGROUND OF THE INVENTION

It is well known to most swimmers that until they become proficient in the skill of swimming, they find it exhausting to swim long distances, so that they must resort to various floatation aids while they stop to rest in order to refresh themselves, before continuing to swim farther. It is accordingly important that such aids be practical and efficient.

SUMMARY OF THE INVENTION

A principal object of the present invention is to provide a swimming appatatus which aids a swimmer, not only to keep afloat, but which also helps to propel him forwardly with less physical effort, so that the device thus serves as a vehicle for a swimmer to ride thereupon in order to travel rapidly over a long distance.

Another object is to provide a water vehicle for being powered by a swimmer who rotates a crankshaft of a paddle wheel that rotates in the water.

Still another object is to provide a water vehicle which includes floatation pontoons that form an integral part of the body thereof for maintaining the craft afloat at all times.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS FIGURES

The figures on the drawings are briefly described as follows.

DETAILED DESCRIPTION OF THE PREFERRED EMBODIMENT

Figures 1, 2, 3, 4, 5:
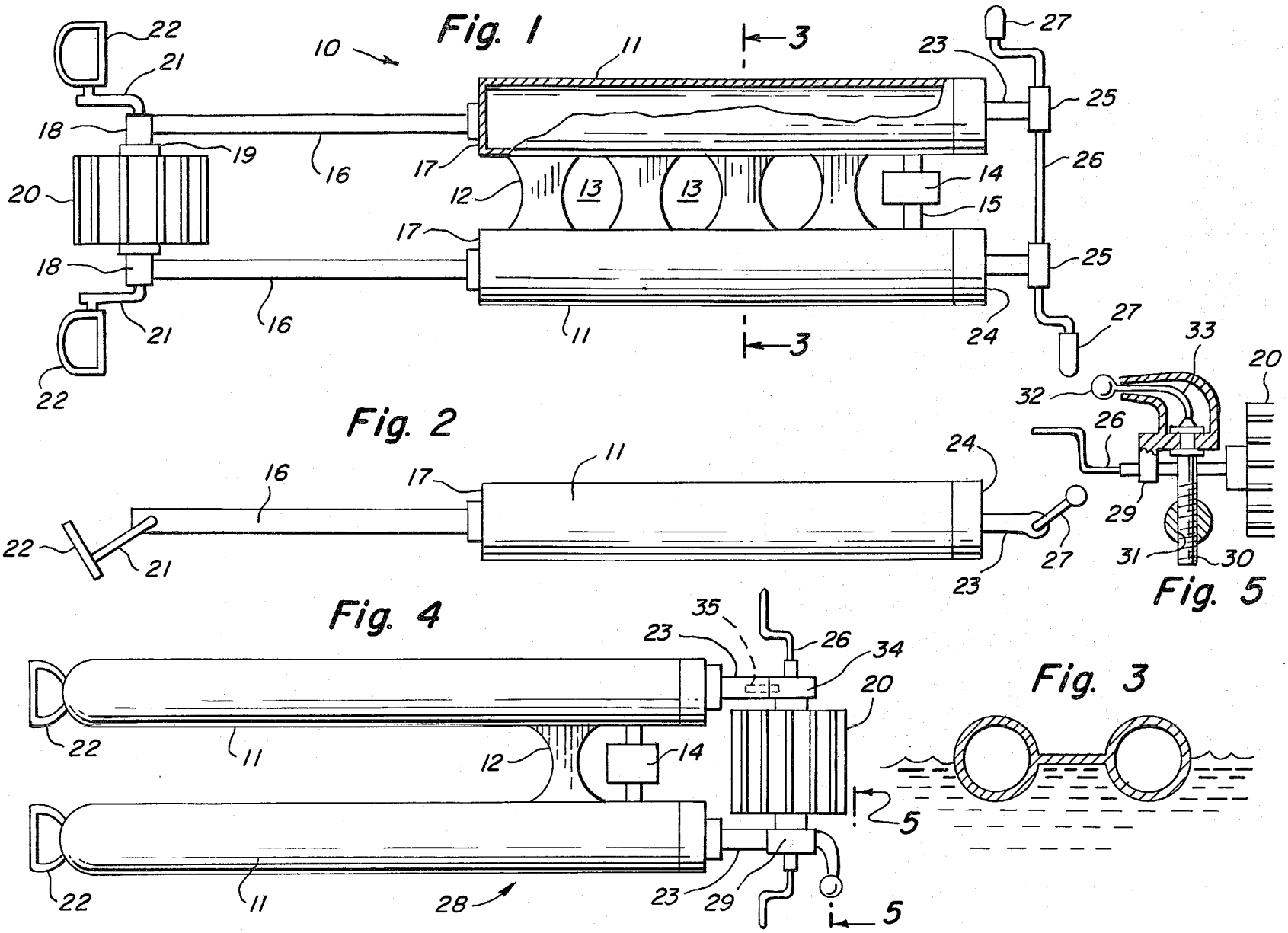
FIG. 1 is a top view of one design of the invention, shown partly in cross section.
FIG. 2 is a side view thereof with the paddle wheel not shown.
FIG. 3 is a cross sectional view on line 3—3 of FIG. 1.
FIG. 4 is a top view of a modified design of the invention.
FIG. 5 is a cross sectional view on line 5—5 of FIG. 4.

Referring now to the drawing in greater detail, and more particularly to FIGS. 1, 2 and 3 thereof, at this time, the reference numeral 10 represents a swimming wheel apparatus, according to the present invention, wherein there are a pair of parallel, side by side, spaced apart, hollow pontoons 11 which have a flat frame 12 therebetween and from an integral part thereof upon which a swimmer can recline; the frame being preferably made of a rigid plastic material or hard rubber that is fixedly secured to the pontoons. A row of cut-away openings 13 along the frame serve to keep the craft lightweight.

A raised chin rest 14, made of resilient cork material is supported upon a cross pipe 15 affixed between a forward portion of the pontoons.

A straight beam 16 extends rearwardly from a rear end 17 of each pontoon, and the rear ends of the beams include bearings 18 between which a transverse crankshaft 19 is supported rotatably free; the crankshaft having a paddle wheel 20 affixed thereupon. An offset crank 21 at each end of the crankshaft supports a stirrup 22 for receiving a swimmer's foot.

A stanchion 23 mounted on a forward end 24 of each pontoon, extends forwardly, and has a bearing 25 at its forward end. A transverse crankshaft 26 supported in the bearings has a crankhandle 27 at each opposite end for being held in the operator's hands.

In operative use, it is now evident that the swimming wheel apparatus serves as a vehicle for a reclining swimmer to travel on the water's surface.

In a modified design 28 of the invention, shown in FIGS. 4 and 5, the stirrups 22 are affixed directly to a rear end of the pontoons 11. The frame 12 between the pontoons is located only between the forward portions thereof.

In this design, the paddle wheel shaft 26 is supported at one end in a bearing block 29 supported upon a screw 30 rotatable in a threaded hole 31 in the stanchion 23. The screw is vertically adjustable by means of a manually rotatable knob 32 connected by a flexible shaft 33 to the screw. The opposite end of the shaft is supported in a bearing block 34 supported pivotally on a pin 35 supported on the stanchion 23. Accordingly this permits lowering or raising one end of the paddle wheel for steering purpose of the craft.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

I claim:

1. A swimming wheel apparatus comprising in combination: a frame; a pair of hollow pontoons separated by said frame and made an integral part thereof, so that said pontoons and said frame together physically touch and support a reclining rider; a paddle wheel powered by said rider for propelling said craft on a water surface, said paddle wheel disposed on straight beams extending from and colinear with said pontoons; a pair of stirrups disposed at one end of said pontoons for said rider's feet, wherein means to steer said craft include a mechanism to tilt said paddle wheel, said mechanism utilizing a manually rotatable knob connected by a flexible shaft to a screw which supports a bearing block which further supports one end of a paddle wheel shaft.

2. The combination as set forth in claim 1 wherein said paddle wheel is affixed on a crankshaft powered by said rider.

* * * * *